US009038728B1

(12) United States Patent
Lugo et al.

(10) Patent No.: US 9,038,728 B1
(45) Date of Patent: May 26, 2015

(54) SYSTEM AND METHOD FOR DIVERTING FLUIDS FROM A WELLHEAD BY USING A MODIFIED HORIZONTAL CHRISTMAS TREE

(71) Applicants: Mario R. Lugo, Houston, TX (US); David Older, Houston, TX (US)

(72) Inventors: Mario R. Lugo, Houston, TX (US); David Older, Houston, TX (US)

(73) Assignee: TRENDSETTER ENGINEERING, INC., Houston, TX (US)

( * ) Notice: Subject to any disclaimer, the term of this patent is extended or adjusted under 35 U.S.C. 154(b) by 199 days.

(21) Appl. No.: 13/856,067

(22) Filed: Apr. 3, 2013

Related U.S. Application Data

(63) Continuation-in-part of application No. 13/269,769, filed on Oct. 10, 2011, now Pat. No. 8,720,580, and a continuation-in-part of application No. 13/160,032, filed on Jun. 14, 2011.

(51) Int. Cl.

| | |
|---|---|
| ***E21B 43/01*** | (2006.01) |
| ***E21B 33/06*** | (2006.01) |
| ***E21B 33/076*** | (2006.01) |
| ***E21B 33/064*** | (2006.01) |
| ***E21B 33/035*** | (2006.01) |
| ***E21B 33/038*** | (2006.01) |

(52) U.S. Cl.
CPC ..... *E21B 33/064* (2013.01); *E21B 33/0355* (2013.01); *E21B 33/038* (2013.01)

(58) Field of Classification Search
USPC ..... 166/338, 344, 345, 347, 363, 364, 368, 166/85.4; 251/1.1
See application file for complete search history.

(56) References Cited

U.S. PATENT DOCUMENTS

| | | | | |
|---|---|---|---|---|
| 8,720,580 | B1 * | 5/2014 | Lugo | 166/344 |
| 2012/0018165 | A1 * | 1/2012 | Crossley et al. | 166/344 |

* cited by examiner

*Primary Examiner* — James G Sayre
(74) *Attorney, Agent, or Firm* — Egbert Law Offices, PLLC

(57) ABSTRACT

A system for diverting fluids from a wellhead in a subsea environment has a capping stack with a connector suitable for connection or interconnection to the wellhead, a flow base fixedly positioned in the subsea environment, and a conduit connected to the outlet of a diverter line of the capping stack and connected to the inlet of an interior passageway of the flow base. The conduit is suitable for passing fluids from the capping stack toward the flow base. The flow base is a modified horizontal Christmas tree. The interior passageway within the horizontal Christmas tree has a plug therein located a level below the level of the inlet to the flow base. The flow base can be attached to a wellhead or to an anchor pile in the subsea environment.

8 Claims, 2 Drawing Sheets

SYSTEM AND METHOD FOR DIVERTING FLUIDS FROM A WELLHEAD BY USING A MODIFIED HORIZONTAL CHRISTMAS TREE

CROSS-REFERENCE TO RELATED APPLICATIONS

The present application is a continuation-in-part of U.S. patent application Ser. No. 13/269,769, filed on Oct. 10, 2011, and entitled "System and Method for Diverting Fluids from a Damaged Blowout Preventer", presently pending. U.S. patent application Ser. No. 13/269,769, is a continuation-in-part of U.S. patent application Ser. No. 13/160,032, filed on Jun. 14, 2011, and entitled "Diverter System for a Subsea Well", presently pending.

STATEMENT REGARDING FEDERALLY SPONSORED RESEARCH OR DEVELOPMENT

Not applicable.

NAMES OF THE PARTIES TO A JOINT RESEARCH AGREEMENT

Not applicable.

INCORPORATION-BY-REFERENCE OF MATERIALS SUBMITTED ON A COMPACT DISC

Not applicable.

BACKGROUND OF THE INVENTION

1. Field of the Invention

The present invention relates to systems for diverting the flow of hydrocarbons from a blowout preventer. More particularly, the present invention the relates to diverters that are applied to the outlet of a blowout preventer so as to provide a safety mechanism in the event of a failure of the blowout preventer. Additionally, the present invention relates to capping stack that are utilized for the purpose of diverting the flow of high pressure fluids to a surface location. Furthermore, the present invention relates to the modification of horizontal Christmas trees so as to provide a proper flow base for the diversion of fluids to a surface location.

2. Description of Related Art Including Information Disclosed Under 37 CFR 1.97 and 37 CFR 1.98.

As the worldwide demand for hydrocarbon fuel has increased, and known onshore reserves have not kept up with the demand, there has been increasing activity in offshore oil exploration and production. Reserves of oil known to exist in the offshore areas have steadily increased and an increasing percentage of world production is from these offshore areas. The offshore environment has presented numerous new challenges to the oil drilling industry which have been steadily overcome to allow efficient drilling and production in these areas, although the costs have been considerably higher than those of onshore operations.

Not only has the offshore environment made production more difficult to accomplish, it has also generally increased the risk of environmental damage in the event of a well blowout or other uncontrolled loss of hydrocarbons into the sea. As a result, known safety equipment, such as blowout preventers which have been used successfully in onshore operations, have been used in offshore operations also. In spite of safety precautions, blowouts of offshore oil wells are known to occur and will occur in the future.

Subsea drilling operations may experience a blowout, which is an uncontrolled flow of formation fluids into the drilling well. These blowouts are dangerous and costly, and can cause loss of life, pollution, damage to drilling equipment, and loss of well production. To prevent blowouts, blowout prevention equipment is required. This blowout prevention equipment typically includes a series of equipment capable of safely isolating and controlling the formation pressures and fluids at the drilling site. BOP functions include opening and closing hydraulically-operated pipe rams, annular seals, shear rams designed to cut the pipe, a series of remote-operated valves to allow control the flow of drilling fluids, and well re-entry equipment. In addition, process and condition monitoring devices complete the BOP system. The drilling industry refers to the BOP system as the BOP stack.

The well and the BOP connect the surface drilling vessel to a marine riser pipe, which carries formation fluids (e.g., oil, etc.) to the surface and circulates drilling fluids. The marine riser pipe connects to the BOP through the Lower Main Riser Package (LMRP) which contains a device to connect to the BOP, an annular seal for well control, and flow control devices to supply hydraulic fluids for the operation of the BOP. The LMRP and the BOP are commonly referred to, collectively, as simply the BOP. Many BOP functions are hydraulically controlled, with piping attached to the riser supplying hydraulic fluids and other well control fluids. Typically, a central control unit allows an operator to monitor and control the BOP functions from the surface. The central control unit includes a hydraulic control system for controlling the various BOP functions, each of which has various flow control components upstream of it.

While many of the techniques used in onshore operations can be applied in the offshore environment, they often prove to be less effective and require a much longer time period for implementation. For example, while relief wells can be drilled to intercept the blowout well, a great amount of time may be required in the drilling operation. In drilling the relief wells, platforms or other drilling support decks must be located and transported to the blowout site before drilling operations can begin. Due to the rugged offshore environment, more time is required to drill the relief wells than would be required in onshore operations. As a result of all of these difficulties, many months can pass between the occurrence of an offshore oil well blowout and the successful final capping of the blown-out well. In the intervening time, large quantities of oil and gas can escape into the ocean with serious environmental impacts.

While a portion of the hydrocarbons lost from a subsea well blowout may be trapped and skimmed by various containment booms and oil skimmer ships, substantial quantities of hydrocarbons can still escape such containment equipment. It can be seen that once the hydrocarbons are allowed to reach the ocean, surface wave action tends to disperse the lighter hydrocarbons which may mix with water or evaporate into the air. The gaseous hydrocarbons, of course, tend to escape into the atmosphere. The heavier ends of the crude oil often form into globules or tar balls which may flow at, or just below, the water's surface so as to make it difficult to contain or to skim up.

Whenever the high pressure hydrocarbons are released into the subsea environment. A waste of the hydrocarbons will occur. If a substantial amount of such hydrocarbons are released, then the production of such hydrocarbons is diminished. As a result, it is desirable to recapture such hydrocarbons and to avoid the release of such hydrocarbons into the subsea environments.

In past diversion systems, a variety of components are connected to a capping stack or a diverter system. These components involve the connection of various hoses to the subsea tree, to the subsea mandrel, or to other apparatus in the subsea environment. This is a very complicated and time-consuming procedure. Several ROVs would be required in order to complete such installations. The completion of such installations can be very difficult considering the nature of the blowout. The equipment often needs to be transported from remote locations in order to be effectively installed. As such, it would be desirable to be able to provide a system whereby the equipment necessary for the capping of the damaged blowout preventer is easily available or made available in the location of the blowout.

In petroleum and natural gas extraction, a "Christmas tree" is an assembly of valves, spools, and fittings used for an oil and gas well. Christmas trees are used on both surface and subsea wells. Christmas tree include conventional, dual bore, mono bore, through flowline, horizontal, mud line, mud line horizontal, side valve, and through-bore trees. The deepest installed Christmas tree is in the Gulf of Mexico at approximately 9,000 feet.

The primary function of a tree is to control the flow of fluid, usually oil or gas, out of the well. The tree may also be used to control the injection of gas or water into a non-producing well in order to improve the production rate of oil from wells. When the well and facilities are ready to produce and receive oil or gas, tree valves are opened and the formation fluids are allowed to go through a flow line. This leads to a processing facility, storage depot and/or other pipeline eventually leading to a refinery or distribution center. Flow lines on subsea wells usually lead to a fixed or floating production platform or to a storage ship or barge.

A tree often provides numerous additional functions including chemical injection points, well intervention means, pressure relief means, monitoring points (such as pressure, temperature, corrosion, erosion, sand detection, flow rate, flow composition, valve and choke position feedback), and connection points for devices such as downhole pressure and temperature transducers. On producing wells, chemicals or alcohols or oil distillates may be injected to preclude production problems (such as blockages).

Functionality may be extended further by using the control system on a subsea tree to monitor, measure, and react to sensor outputs on the tree or even down the well bore. The control system attached to the tree controls the downhole safety valve while the tree acts as an attachment and conduit means of the control system to the downhole safety valve.

Tree complexity has increased over the last few decades. They are frequently manufactured from blocks of steel containing multiple valves rather than being assembled from individual flanged components. This is especially true in subsea applications where the resemblance to Christmas trees no longer exists given the frame and support systems into which the main valve block is integrated.

The Christmas tree is installed on top of the wellhead. A wellhead is used without a Christmas tree during drilling operations, and also for riser tie-back situations that later would have a tree installed at the riser top.

Subsea trees have a large variety of valve configurations and combinations of manual and/or actuated hydraulic or pneumatic valves. A typical tree will have at least four or five valves. There are a pair of lower valves which are called the master valves. Master valves are normally in the fully open position and are never opened or closed when the well is flowing so as to prevent erosion of the valve sealing surfaces. An actuated wing valve is normally used to shut in the well when flowing, thus preserving the master valves for positive shutoff for maintenance purposes. Hydraulically-operated wing valves are usually built to be failsafe closed, meaning they require active hydraulic pressure to stay open. This feature means that if the control fluids fail, the well will automatically shut itself in without operator action. A valve at the top is called the swab valve and lies in the path used for well interventions, such as wirelines. For such operation, a lubricator is rigged up onto the top of the tree and the wire or coil is lowered through the lubricator, past the swab valve and into the well. Some trees have a second swab valve in which the valves are arranged one on top of the other.

Subsea trees are available in either vertical or horizontal configurations. Typically, a subsea tree would have a choke (permitting the control of flow), a flow line connection interface (such as a hub, a flange or other connection), a subsea control interface (direct hydraulic, electro hydraulic, or electric) and sensors for gathering data such as pressure, temperature, sand flow, erosion, multiphase flow, and single phase flow.

One type of Christmas tree has a pair of bores extending through it. One of bores is the production bore and the other is a tubing annulus access bore. In this type of wellhead assembly, the tubing hanger lands in the wellhead housing. The tubing hanger has two passages through it. One passage is the production passage and the other passage is an annulus passage that communicates with the tubing annulus surrounding the tubing. Access to the tubing annulus is necessary to circulate fluids down the production tubing and up through the tubing annulus, or vice versa, to either kill the well or circulate out heavy fluid during completion.

After the tubing hanger is installed and before the drilling riser is removed for installation of the tree, plugs are temporarily placed in the passages of the tubing hanger. The tree has isolation tubes that stab into engagement with the passages in the tubing hanger when the tree lands on the wellhead housing. This type of tree is normally run on a completion riser that has two strings of conduit. In a dual string completion riser, one string extends from the production passage of the tree to the surface vessel, while the other extends from the tubing annulus passage in the tree to the surface vessel.

Used horizontal Christmas trees are readily available. However, the refurbishment of such used horizontal Christmas tree is a very complex, time-consuming and expensive task. Ultimately, the cost of refurbishing a used horizontal Christmas tree can be nearly equal to the cost associated with a new Christmas tree. During refurbishment, the wide variety of valves and controls must be completely modified so as to avoid problems associated with corrosion and erosion. Unless extensive modifications are made to these used Christmas trees, there can be a wide variety of leak paths which can occur if the used Christmas tree is utilized without refurbishment. As such, typically, refurbishment of horizontal Christmas trees is not an attractive alternative to producers. As a result, a very large number of used horizontal Christmas tree are available for use.

The "flow base" that was described in U.S. patent application Ser. No. 13/160,032, to the present inventor, is an available alternative for diverting fluids from a damaged blowout preventer. However, this flow base is attachable to the capping stack is an original piece of equipment. As such, it is relatively expensive to produce. Additionally, the manufacturing delay associated with the formation of such a flow base could be too slow in order to meet the exigencies associated with a well blowout or damaged blowout preventer. As such, a need has developed so as to provide a proper flow base that can be readily available and can be available with a minimal cost.

In the past, various patents and patent publications have issued relating to systems for the containment of oil spills and blowouts. For example, U.S. Pat. No. 4,324,505, issued on Apr. 13, 1982 to D. S. Hammett, discloses a subsea blowout containment method and apparatus. This blowout containment apparatus comprises an inverted funnel adapted for positioning over a wellhead to receive fluids from the well and direct them into a conduit extending from the funnel to surface support and processing equipment. The funnel and conduit are supported from the sea's surface, preferably by a vessel such as a barge. The barge carries the equipment to receive the full flow of fluids from the well, to process the fluids, and to conduct the liquids to a nearby tanker where the recovered liquid hydrocarbons may be stored.

U.S. Pat. No. 4,405,258, issued on Sep. 20, 1983 to O'Rourke et al., describes a method for containing oil and/or gas within a blow-out cover dome. This method includes the steps of deploying a containment dome in shallow water near the location of the seabed where the containment dome is to be located. The containment dome has an upper expanded dome-like fluid impervious membrane, a fluid impervious hollow peripheral ring attached to the periphery of the membrane to provide a depending bag-like container, and discrete water drainage means within the bag-like container for connection to pump conduit means therefrom. Wet sand from the seabed is then pumped into the bag-like container. Water is then drained from the wet sand through the water drainage means so as to provide a body of drained sand disposed within the bag-like container and providing a hollow peripheral ring as a hollow peripheral torus acting as a self-supporting structure and as an anchor for the dome-like structural unit. The dome is then charged with a buoyant amount of air and the buoyed dome is floated out to the site where the dome is to be deployed. It is then submerged by controllably releasing the air while substantially simultaneously filling the dome with water, thereby sinking the dome until the lighter-than-water fluid is captured within the dome.

U.S. Pat. No. 4,828,024, issued on May 9, 1989 to J. R. Roche, describes a diverter system and blowout preventer. The system comprises a blowout preventer attached above a spool having a hydraulically-driven sleeve/piston. An outlet flow passage exists in the spool. This outlet flow passage can be connected to a vent line. The outlet flow passage is closed off by the sleeve wall when the spool piston is at rest. Hydraulic ports are connected above and below the blowout preventer annular piston and above and below the spool annular piston. The ports below the blowout preventer piston and above the spool piston are in fluid communication with each other. A hydraulic circuit is provided having two valves between a source of pressurized hydraulic fluid and a drain.

U.S. Pat. No. 5,984,012, issued on Nov. 16, 1999 to Wactor et al., provides an emergency recovery system for use in a subsea environment. This emergency recovery system has a casing that is open at each end with a shackle connected to one end of the casing with the opposite end of the shackle designed for connection to appropriate points on the main stack and lower marine riser package in any orientation. A flexible sling with a closed loop formed at each end is used with one of the closed loops releasably connected to the shackle and the end of the casing. The other end of the sling has a flotation member attached to the sling adjacent the closed loop. The sling is fan folded as it is lowered into the casing. The flotation member is shaped to fit inside the other end of the casing with the closed end loop of the sling protruding from the casing. The flotation member is constructed of synthetic foam and is sized to provide sufficient buoyancy to fully extend the sling when the release ring is released by a remotely operated vehicle in a subsea environment.

U.S. Pat. No. 7,165,619, issued on Jan. 23, 2007 to Fox et al., teaches a subsea intervention system that includes a BOP module and CT module. A tool positioning system is used for positioning a selected subsea tool stored within a rack with a tool axis in line with the BOP axis, while a marinized coiled string injector is moved by positioning system to an inactive position. Power to the subsea electric motors is supplied by an electrical line umbilical extending from the surface for powering the pumps. An injector is provided that includes a pressure compensator roller bearing and a pressure-compensated drive system case.

U.S. Pat. No. 7,597,811, issued on Oct. 6, 2009 to D. Usher, provides a method and apparatus for subsurface oil recovery using a submersible unit. The submersible vehicle is positioned above the bed of a diver supported on a platform above the pollutant. A wand at one end of a pipe evacuated by a centrifugal pump is manipulated to draw the pollutant to the surface for treatment or disposal.

U.S. Pat. No. 7,921,917, issued on Apr. 12, 2011 to Kotrla et al., shows a multi-deployable subsea stack system. This subsea stack system includes a lower marine riser package, a blowout preventer stack with a first ram blowout preventer, and an additional blowout preventer package releasably coupled to the blowout preventer stack and comprising a second ram blowout preventer. The subsea blowout preventer stack assembly can be deployed by coupling a drilling riser to the lower marine riser package that is releasably connected to the blowout preventer stack. The lower marine riser package and blowout preventer stack are then attached to a subsea wellhead and then landed on the additional blowout preventer package that is coupled to the subsea wellhead.

U.S. Patent Publication No. 2009/0095464, published on Apr. 16, 2009 to McGrath et al., provides a system and method for providing additional blowout preventer control redundancy. This system has backup or alternate fluid flow routes around malfunctioning BOP control components using a remotely-installed removable hydraulic hose connection. The backup fluid flow route sends pressure-regulated hydraulic fluid to a BOP operation via an isolation valve rigidly attached to the BOP, then to a hose connected to an intervention panel on the BOP, and finally through a valve that isolates the primary flow route and establishes a secondary flow route to allow continued operation.

U.S. Patent Publication No. 2009/0260829, published on Oct. 22, 2009 to D. J. Mathis, provides a subsea tree safety control system that limits the probability of failure on demand of a subsea test tree. A safety shut-in system is provided for actuating a safety valve of the subsea test tree. The safety shut-in system includes a surface control station positioned above a water surface connected via an umbilical to a subsea control system positioned below the water surface so as to actuate the safety valve.

U.S. Pat. No. 4,444,250, issued on Apr. 24, 1984 to Keithahn et al., teaches a flow diverter apparatus having a housing and a piston with an annular packer disposed therein. The diverter has passages in the piston and housing walls providing fluid communication between the borehole and a vent line. A valve in the vent line is opened before the packer of the apparatus is closed about a tubular member in the bore or completely closes the vertical flow path of the bore. This diverts pressurized borehole fluid away from the rig equipment and personnel.

U.S. Pat. No. 4,502,534, issued on Mar. 5, 1985 to Roche et al., describes a flow diverter for connection to a drilling conduit beneath a drilling rig floor for diverting pressurized well bore fluid in the conduit from the rig and sealing the annulus between a pipe or other object and the conduit or closing the vertical flow path of the conduit. The apparatus has a housing, and annular packing element and two pistons. The housing is provided with at least one outlet passage in the wall of its body. One of the two pistons acts as a sliding sleeve valve in cooperation with the housing wall for preventing fluid communication between the outlet passage and the interior of the housing when it is in a nonactuated or normal position and for allowing fluid communication when it is in an actuated or diverting position.

U.S. Pat. No. 4,646,844, issued on Mar. 3, 1987 to Roche et al., shows a diverter/BOP system and method for a bottom-supported offshore drilling rig. The system includes a fluid flow controller and at least two bases adapted for being alternatively removably secured to the controller. When the first base is in combination with the fluid flow controller, the system may be used only as a diverter and when the second base is used in combination with the fluid flow controller the system may be used only as a blowout preventer.

U.S. Pat. No. 5,323,860, issued on Jun. 28, 1994 to B. J. Watkins, describes an apparatus for connecting a diverter assembly to a blowout preventer stack. An upper tubular member is adapted to be connected to the diverter assembly to form a lower continuation of the lower end of its bore. A lower tubular member is adapted to be connected to the blowout preventer stack to form an upper continuation of the upper end of its bore. A tubular body extends between and is pivotally and sealably connected to the upper and lower tubular members to connect their bores.

U.S. Pat. No. 6,230,824, issued on May 15, 2001 to Peterman et al., teaches a rotating subsea diverter for isolating fluid in a well from other fluid above the well. The rotating diverter includes a housing body which has a bore running through it. A retrievable spindle assembly includes a spindle and a bearing assembly that is disposed in the bore. The bearing assembly supports the spindle for rotation. The spindle is adapted to receive and seal around a tubular member. The rotation of the tubular member rotates the spindle within the bore.

U.S. Pat. No. 7,308,954, issued on Dec. 18, 2007 to P. S. Martin-Marshall, shows a rotating diverter head for use on a blow out preventer stack of an oil well. The head provides for sealing and rotation of a drill pipe through the head and includes a flange on which the head is rotatable. The flange connects the head to the stack whereupon it can be rotated to align a return flow line before being locked in position.

U.S. Patent Publication No. 2006/0037782, published on Feb. 23, 2006 to P. S. Martin-Marshall, describes a monitoring system for a rotating diverter head for use in an oil well. The system includes a pressure sensor which is mounted beside the stripper rubber which contacts the drill pipe. An increase in the pressure monitored provides early warning of degradation or imminent failure of the seal.

It is an object of the present invention to provide an apparatus for containing the flow of fluids resulting from a damaged or defective blowout preventer.

It is another object of the present invention to provide a system and method that can recover substantially all of the fluids flowing from the blowout preventer and for preventing the mixing of such fluids with seawater.

It is another object of the present invention to provide a system and method whereby high pressure fluids from the subsea well can be effectively contained and/or transported to the surface.

It is another object of the present invention to provide a system and method which can be made readily available in the event of an emergency condition.

It is still another object of the present invention to provide a system and method which can effectively utilize equipment in the vicinity of the damaged blowout preventer.

It is still another object of the present invention to provide a system and method whereby the equipment utilized for the control of the damaged blowout preventer is easily installed with conventional equipment.

These and other objects and advantages of the present invention will become apparent from a reading of the attached specification and appended claims.

BRIEF SUMMARY OF THE INVENTION

The present invention is a system for diverting fluids from a wellhead. This system comprises a capping stack having a connector suitable for connection or interconnection to the wellhead. The capping stack has a fluid passage extending from the connector. The capping stack has at least one diverter line in communication with the fluid passage. The diverter line has an outlet. A flow base is fixedly positioned in the subsea environment. The flow base has an interior passageway and an inlet extending to the interior passageway. The flow base has an outlet. A conduit is connected to the outlet of the diverter line of the capping stack and connected to the inlet of the flow base. The conduit is suitable for passing fluids from the capping stack toward the flow base.

In the present invention, the flow base is a horizontal Christmas tree. The interior passageway of the horizontal Christmas tree has a plug therein. This plug is positioned in the interior passageway at a level below a level the inlet. The horizontal Christmas tree has a valve block on a side thereof. The inlet extends through the valve block. The inlet is in valved communication with the interior passageway of the horizontal Christmas tree.

The flow base has a tubing head connector at a lower end thereof. The tubing head connector is suitable for connection to a subsea structure. In one embodiment of the present invention, the subsea structure is another wellhead. In another embodiment of the present invention, the subsea structure is a pile.

The present invention is also a method of diverting fluids from a damaged blowout preventer. The method comprises the steps of: (1) positioning a capping stack onto an upper end of the damaged blowout preventer; (2) attaching a flow base onto a subsea structure; (3) connecting a conduit to the outlet of the diverter line of the capping stack and to the inlet of the flow base; and (4) passing fluid from the damaged blowout preventer through the fluid passage of the capping stack such that the fluid flows through the conduit and into and through the interior passageway of the flow base. The fluid exits the flow base through the outlet.

The method of present invention further includes the steps of affixing a blowout preventer over the outlet of the flow base, and attaching a landing string to the blowout preventer so as to allow the fluids passing through the blowout preventer to pass to another location, such as a surface location.

The method of the present invention further includes modifying an existing horizontal Christmas tree so as to form the flow base. A plug is installed within the interior passageway of the modified horizontal Christmas tree at a level below a level of the inlet of the flow base. As such, any fluids flowing through the interior passageway of the flow base will flow upwardly. The flow base can be attached to a wellhead or to an anchor pile.

This foregoing Section is intended to described, in generality, the preferred embodiment of the present invention. It is understood that modifications to this preferred embodiment can be made without departing from the spirit of the invention. As such, this Section should not to be construed as limiting, in any way, of the broad scope of the present invention. The present invention should only be limited by the following claims and their legal equivalents.

DETAILED DESCRIPTION OF THE INVENTION

Figure 1:
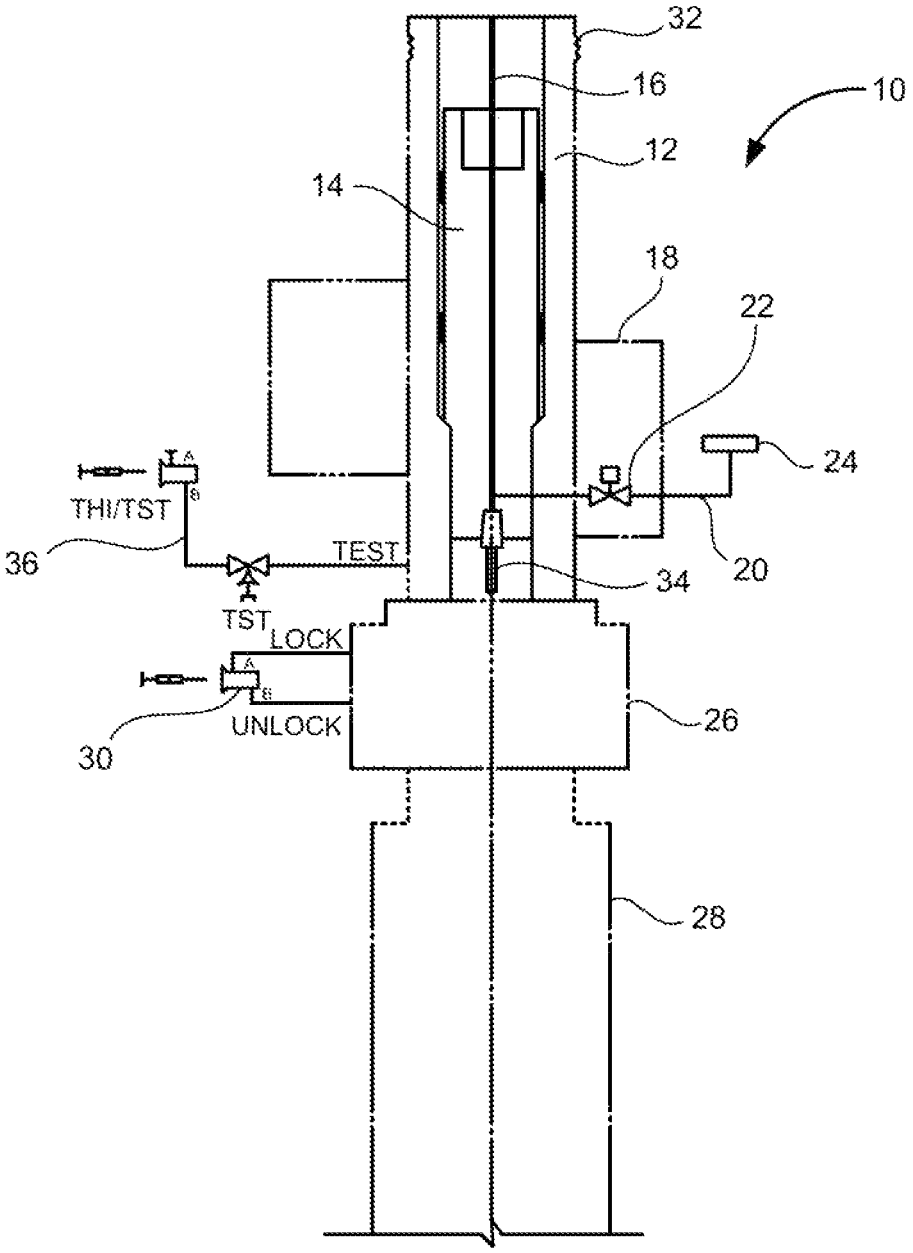
FIG. 1 is a cross-sectional and schematic of the flow base in accordance with the preferred embodiment of the present invention.

Referring to FIG. 1, there is shown the flow base 10 as used in the system for diverting fluids from a damaged blowout preventer in accordance with the teachings of the present invention. The flow base 10 has a body 12 having an interior passageway 14. As can be seen by line 16 in FIG. 1, there is a flow passageway through the interior passageway 14 so as to allow the flow of fluid from the capping stack or flow diverter associated with the blowout preventer. A valve block 18 extends outwardly of the side of the body 12. An inlet line 20 extends through the valve block 18 so as to communicate with the flow passageway 16. The inlet 20 has a master valve 22 associated therewith. Master valve 22 is located on valve block 18 so as to be manipulated by a remotely-operated vehicle (ROV) or by remote applications. Ultimately, a connector 24 is positioned at the end of the inlet 20 so as to allow for connection to another conduit, flow line or jumper.

The flow base 10 includes a tubing head connector 26 located at a lower end thereof. Tubing head connector 26 is suitable for connection to a subsea structure 28. In FIG. 1, the subsea structure 28 can be an anchor pile or a wellhead. A lock control mechanism 30 is cooperative with the tubing head connector 26 so as to assure a proper locking of the tubing head connector 26 to the subsea structure 28.

A mandrel 32 is located at an end of the body 12 opposite the tubing head connector 26. The mandrel 32 is suitable for connection to a blowout preventer. As such, a blowout preventer can be secured to the mandrel 32 such that the interior passageway 14 and the flow passageway 16 will communicate with the interior passageway of the blowout preventer. Ultimately, a landing string can be connected to the blowout preventer such that any fluids passing through the flow passageway 16 can be moved to another location, such as a surface location. As such, the fluids passing through the flow passageway 16 can be recovered.

Within the concept of the present invention, the flow base 10 is in the nature of a modified horizontal Christmas tree. As was stated hereinbefore, a typical horizontal Christmas trees has a large number of components, valves, controls, conduits and other mechanisms. Used horizontal Christmas trees are readily and inexpensively available in the marketplace. As was stated previously, the cost of modifying horizontal Christmas trees in order to satisfy the requirements of a horizontal Christmas tree is too expensive. As such, it is unusual to ever use a modified horizontal Christmas tree in actual horizontal Christmas tree application. The present invention actually modifies the used horizontal Christmas tree so as to achieve the purposes of the flow base of the present invention.

As can be seen in FIG. 1, the modified horizontal Christmas tree has virtually all of the components removed therefrom. In other words, the various controls, gauges, valves and the annulus line have been removed from horizontal Christmas tree. Fundamentally, the inlet 20, along with the master valve 22, remain as part of the external components of the horizontal Christmas tree. As such, the horizontal Christmas tree will relatively easy to modify for the purposes of the flow base 10 of the present invention.

In order to complete the modification of the existing horizontal Christmas tree, a plug 34 is inserted into the flow passageway 16. The plug 34 is installed so as to block the flow of fluids from the subsea structure 22 or the tubing head connector 26 through the flow passageway 16. The plug 34 is located at a level below the level of the inlet 20 so that any fluids passing through the inlet 20 will flow only upwardly through the flow passageway 16. A test line 36 is provided in association with the flow base 10 so as to allow for the test of the integrity of the plug 34, as installed.

Figure 2:
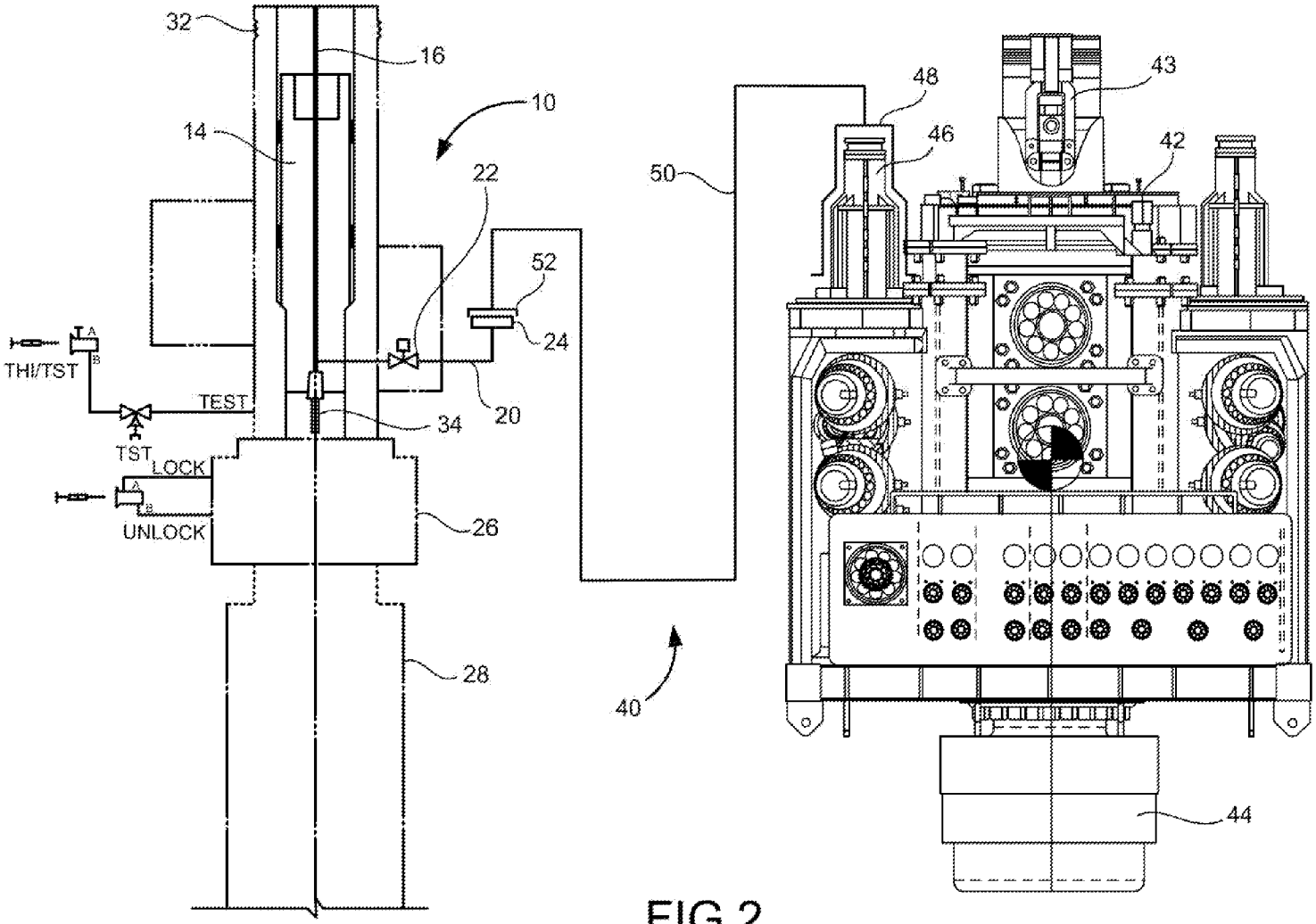
FIG. 2 is a diagrammatic illustration of the system for diverting fluids from a damaged blowout preventer in accordance with the teachings of the present invention.

FIG. 2 shows the system 40 of the present invention. The system 40 includes a capping stack 42 having a connector 44 located at a bottom end thereof. The connector 44 is suitable for connection to the damaged blowout preventer and/or to the wellhead. The capping stack 42 is of a configuration described in U.S. patent application Ser. No. 13/160,032, filed on Jun. 14, 2011, to the present inventor. The capping stack 42 will have a fluid passage 43 extending from the connector 44 through the interior of the capping stack 42. The capping stack 42 has a diverter line 46 in communication with the flow passageway 43. The diverter line 46 has an outlet 48. As was described in U.S. patent application Ser. No. 13/160,032, when a damaged blowout preventer occurs, the connector 44 can be installed on the mandrel 32 associated with the damaged blowout preventer. The fluid passage 43 will be opened during this installation so that fluid flow will pass through the fluid passage 43. After installation, various valves associated with the flow passageway 43 will be selectively closed so that the fluid will flow through the diverter line 46 and outwardly through the outlet 48. A conduit 50, in the nature of a flowline or jumper, is affixed to the outlet of the diverter line 46. As such, the fluids will flow through the conduit 50. Conduit 50 has an opposite end that is affixed to the connector 24 of the inlet 20 of the flow base 10. The flow through the conduit 50 will pass through the inlet 20 and through the open valve 22. The flow will then flow through flow passageway 16 and outwardly of the flow base 10. The flow is directed upwardly by the placement of the plug 34 within the flow passageway 16 of the flow base 10. The valve 22 can be closed until such time as the proper connection is established between the end 52 of the conduit 50 and the connector 24 of the inlet 20. After the connection is complete, the valve 22 can be opened so as to establish the fluid flow.

It can be seen in FIG. 2 that the flow base 10 is attached the subsea structure 28. The subsea structure 28 can be an existing wellhead in a location adjacent to the damaged blowout preventer associated with the capping stack 42. As such, in emergency conditions, it is only necessary to install the flow base 10 upon such subsea structure 28. In other circumstances, an anchor pile can be lowered to the subsea soil and installed therein. The anchor pile can have a suitable mating connector at an upper end thereof. As such, the tubing head connector 26 of the flow base 10 can be joined to the connector of the anchor pile. The flow base 10 can be installed in a simple and efficient manner.

The valve 22 remain closed until a suitable blowout preventer can be installed onto the mandrel 32 of the flow base 10. A landing string can be connected to the blowout preventer through the use of a subsea test tree. At such time, the valve 22 can be opened so that the flow of fluid passes through the outlet of the flow passageway 16, through the blowout preventer and through the landing string. Any fluids passing through the capping stack 42 and outwardly of the diverter line 46 can be captured at the surface or at another location.

In the present invention, by utilizing a modified horizontal Christmas tree, the emergency conditions associated with a damaged blowout preventer or a damaged wellhead can be quickly and easily addressed. An existing horizontal Christmas tree can be modified in the manner of the flow base 10 in a simple, quick and convenient manner. There is a minimal amount of expense associated with the creation of the flow base 10. The flow base 10 can be easily installed to the subsea structure 28 in a simple and efficient manner. It is only necessary to locate another blowout preventer and install the blowout preventer on the mandrel 32. The production fluids can then be passed and recovered through the use of the present invention.

The foregoing disclosure and description of the invention is illustrative and explanatory thereof. Various changes in the details of the illustrated construction can be made within the scope of the appended claims without departing from the true spirit of the invention. The present invention should only be limited by the following claims and their legal equivalents.

We claim:

1. A system for diverting fluids from a wellhead in a subsea environment, the system comprising:

a capping stack having a connector suitable for connection or interconnection to the wellhead, said capping stack having a fluid passage extending from said connector, said capping stack having at least one diverter line in communication with said fluid passage, said diverter line having an outlet;

a flow base fixedly positioned in said subsea environment, said flow base having an interior passageway and an inlet extending to said interior passageway, said flow base having an outlet; and a conduit connected to said outlet of said diverter line of said capping stack and connected to said inlet of said flow base, said conduit suitable for passing fluids from said capping stack toward said flow base, said flow base being a horizontal Christmas tree, said interior passageway having a plug therein.

2. The system of claim 1, said plug positioned in said interior passageway of said horizontal Christmas tree at a level below a level of said inlet.

3. The system of claim 1, said horizontal Christmas tree having a valve block on a side thereof, said inlet extending through said valve block, said inlet having a valve communicating with said interior passageway of said horizontal Christmas tree.

4. A system for diverting fluids from a wellhead in a subsea environment, the system comprising:

a capping stack having a connector suitable for connection or interconnection to the wellhead, said capping stack having a fluid passage extending from said connector, said capping stack having at least one diverter line in communication with said fluid passage, said diverter line having an outlet;

a flow base fixedly positioned in said subsea environment, said flow base having an interior passageway and an inlet extending to said interior passageway, said flow base having an outlet; and a conduit connected to said outlet of said diverter line of said capping stack and connected to said inlet of said flow base, said conduit suitable for passing fluids from said capping stack toward said flow base, said flow base having a tubing head connector at a lower end thereof, said tubing head connector suitable for connection to a subsea structure, said subsea structure being another wellhead.

5. A system for diverting fluids from a wellhead in a subsea environment, the system comprising:

a flow diverter suitable for connection or interconnection to the wellhead, said flow diverter having a fluid passage therein, said fluid passage having an outlet;

a flow base fixedly positioned in said subsea environment, said flow base having an interior passageway and an inlet extending to said interior passageway, said flow base having an outlet; and a conduit connected to said outlet of said diverter line and connected to said inlet of said interior passageway of said flow base, said conduit suitable for passing fluids from said flow diverter toward said flow base, said interior passageway of said flow base having a plug therein positioned at a level below a level of said inlet to said interior passageway such that fluid flows only upwardly in said interior passageway of said flow base.

6. The system of claim 5, said flow base being a modified horizontal Christmas tree.

7. A system for diverting fluids from a wellhead in a subsea environment, the system comprising:

a flow diverter suitable for connection or interconnection to the wellhead, said flow diverter having a fluid passage therein, said fluid passage having an outlet;

a flow base fixedly positioned in said subsea environment, said flow base having an interior passageway and an inlet extending to said interior passageway, said flow base having an outlet; and a conduit connected to said outlet of said diverter line and connected to said inlet of said interior passageway of said flow base, said conduit suitable for passing fluids from said flow diverter toward said flow base, said modified horizontal Christmas tree having a valve block on a side thereof, said inlet extending through said valve block, said inlet being a valved communication with said interior passageway of said modified horizontal Christmas tree.

8. A system for diverting fluids from a wellhead in a subsea environment, the system comprising:

a flow diverter suitable for connection or interconnection to the wellhead, said flow diverter having a fluid passage therein, said fluid passage having an outlet;

a flow base fixedly positioned in said subsea environment, said flow base having an interior passageway and an inlet extending to said interior passageway, said flow base having an outlet; and a conduit connected to said outlet of said diverter line and connected to said inlet of said interior passageway of said flow base, said conduit suitable for passing fluids from said flow diverter toward said flow base, said flow base having a tubing head connector at a lower end thereof, said tubing head connector suitable for connection to a subsea structure, said subsea structure being another wellhead.

* * * * *